United States Patent [19]

McCarty et al.

[11] 4,297,854

[45] Nov. 3, 1981

[54] AIR VALVE HEAT PUMP

[75] Inventors: William J. McCarty; Bruce L. Ruark, both of Louisville, Ky.

[73] Assignee: General Electric Company, Louisville, Ky.

[21] Appl. No.: 144,796

[22] Filed: Apr. 28, 1980

[51] Int. Cl.[3] ..... F25B 29/00

[52] U.S. Cl. ..... 62/325

[58] Field of Search ..... 62/140, 160, 325

[56] References Cited

U.S. PATENT DOCUMENTS

| | | | |
|---|---|---|---|
| 2,391,151 | 12/1945 | Gibson | 62/325 |
| 2,401,560 | 6/1946 | Graham et al. | 62/325 |
| 2,466,383 | 4/1949 | Cody | 62/325 |
| 2,729,072 | 1/1956 | Dybvig | 62/325 |
| 2,878,657 | 3/1959 | Atchison | 62/325 |
| 2,899,802 | 8/1959 | McMillan | 62/157 |
| 2,911,797 | 11/1959 | Stocking | 62/176 |
| 2,970,816 | 2/1961 | McCarty | 62/325 |
| 2,975,611 | 3/1961 | Pietsch | 62/151 |
| 3,084,522 | 4/1963 | Hames, Jr. et al. | 62/325 |
| 3,143,864 | 8/1964 | Schordine | 62/325 |
| 3,995,446 | 12/1976 | Eubank | 62/325 |

*Primary Examiner*—Lloyd L. King

*Attorney, Agent, or Firm*—Frank P. Giacalone; Radford M. Reams

[57] ABSTRACT

The present invention relates to a heat pump that utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquefying the refrigerant and outside again; and indoor air is passed in heat exchange relationship with the evaporator for cooling the air circulated again. Conversely, in the heating mode, outdoor air passed in heat exchange relationship with the evaporator for vaporizing the refrigerant, then outside again; and indoor air is passed in heat exchange relationship with the condenser for heating the air and circulated again.

22 Claims, 5 Drawing Figures

FIG. 5
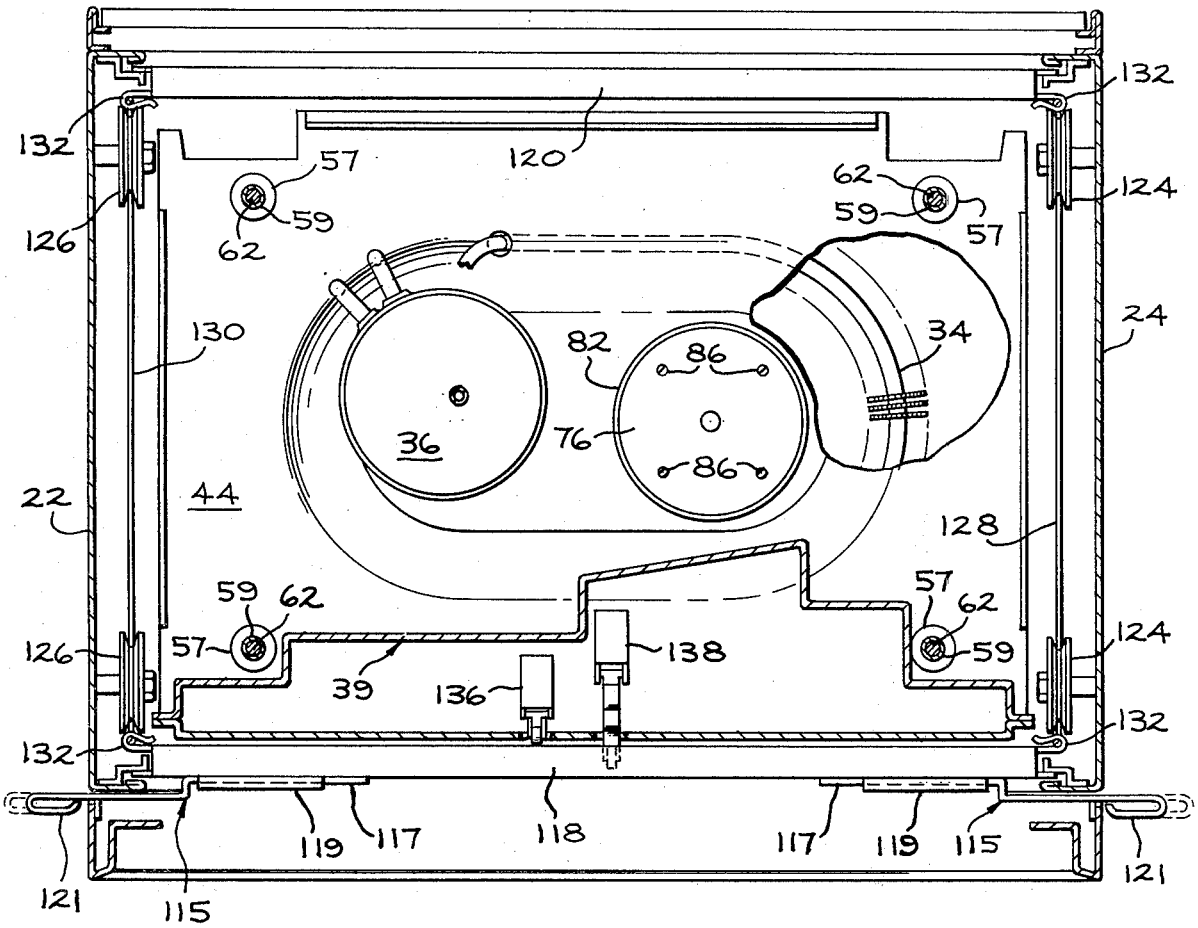
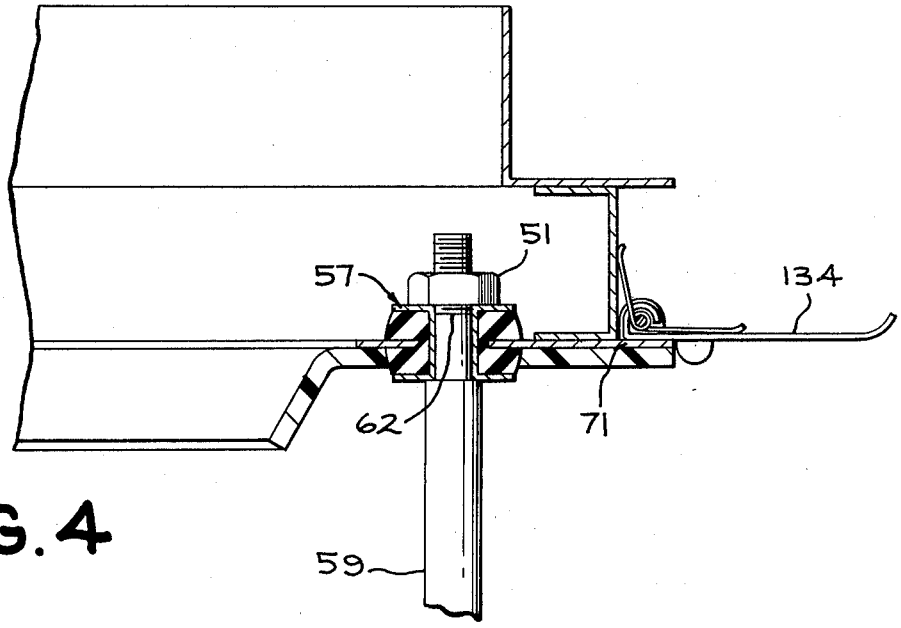
FIG. 4

AIR VALVE HEAT PUMP

BACKGROUND OF THE INVENTION

This invention relates to air conditioners known as heat pumps: and, more particularly, to a reverse air cycle air conditioner that may be used for cooling or heating by redirecting air distribution.

There are two common types of heat pumps, or air conditioners that are used for heating as well as cooling. One type of heat pump reverses the refrigerant flow, thus the functions of the evaporator and condenser interchange. This type has disadvantages; including the use of a relatively expensive reversing valve, and other components necessary to allow the interchange of heat exchangers that may be costly to replace and maintain.

Another type of heat pump utilizes unidirection refrigerant flow wherein the condenser and evaporator retain their functions, but the air directed across them is redirected for different operations. While the heat pump is operating in the cooling mode, outdoor air is passed in heat exchange relationship with the condenser for liquifying the refrigerant and outside again; and indoor air is passed in heat exchange relationship with the evaporator for cooling the air circulated again. Conversely, in the heating mode, outdoor air passes in heat exchange relationship with the evaporator for vaporizing the refrigerant, then outside again; and indoor air is passed in heat exchange relationship with the condenser for heating the air and circulated again.

One prior art patent, U.S. Pat. No. 2,878,657—Atchison, assigned to General Electric Company, the assignee of the present invention, discloses the latter type heat pump wherein the air conditioning unit includes a plurality of air controlling valves each of which is associated with an opposed inlet and outlet opening of the unit that permit selective control of the air flowing into and discharging from the unit in order to direct air either from the outside or from within the enclosure over either of the heat exchangers disposed within separate compartments of the unit.

Another prior art patent, U.S. Pat. No. 3,995,446, discloses a unit having a rotatable damper that can mutually and exclusively place the condenser and evaporator in the desired degree of communication with the outdoor or the indoor.

SUMMARY OF THE INVENTION

The present invention provides an air conditioning apparatus for conditioning air in an enclosure having a wall opening, and more particularly to an air conditioner including a housing adapted to be positioned in the wall opening with one side of said housing facing the outdoors and the opposite side of the housing facing said enclosure. A central chamber is defined by spaced partitions dividing the housing into an evaporator compartment and a condenser compartment. Arranged in the housing is a refrigerating system including a condenser in the condenser compartment, an evaporator in the evaporator compartment and a compressor in the central compartment. Positioned in each of the compartments is a fan shroud that substantially divides the evaporator and condenser compartments into inlet and outlet sections, each of the sections having an opening in both the indoor and outdoor facing side of the housing. A fan is positioned in each of the shrouds for circulating air through the evaporator and condenser compartments in a direction from the inlet section to the outlet section. Means for moving air include a fan motor mounted in one of the central partitions having a shaft extending into the evaporator compartment for driving one of the fans, and a second fan motor mounted in the other central partition having a shaft extending into the condenser compartment for driving the other fan. Movable air valve means are provided for controlling the flow of air through the evaporator and condenser compartments for heating or cooling the enclosure. The air valve means include a first damper slidably arranged in the indoor facing side of the housing that is associated with the indoor facing openings of the compartments and a second damper slidably arranged in the outdoor facing side of the housing that is associated with the outdoor facing opening of the compartments. The dampers are selectively positioned to a first cooling position wherein the indoor facing openings of the evaporator compartment communicate with the enclosure and the outdoor facing openings of the condenser compartment communicate with the outdoors for cooling the air, and to a second heating position wherein the indoor facing openings in the condenser compartment communicate with the indoors for heating the air.

DESCRIPTION OF THE DRAWINGS

FIG. 4 is a fragmentary sectional view showing a detail of the chassis; and

FIG. 5 is a sectional plan view taken along lines 5—5 of FIG. 1.

DESCRIPTION OF THE PREFERRED EMBODIMENT

Figure 1:
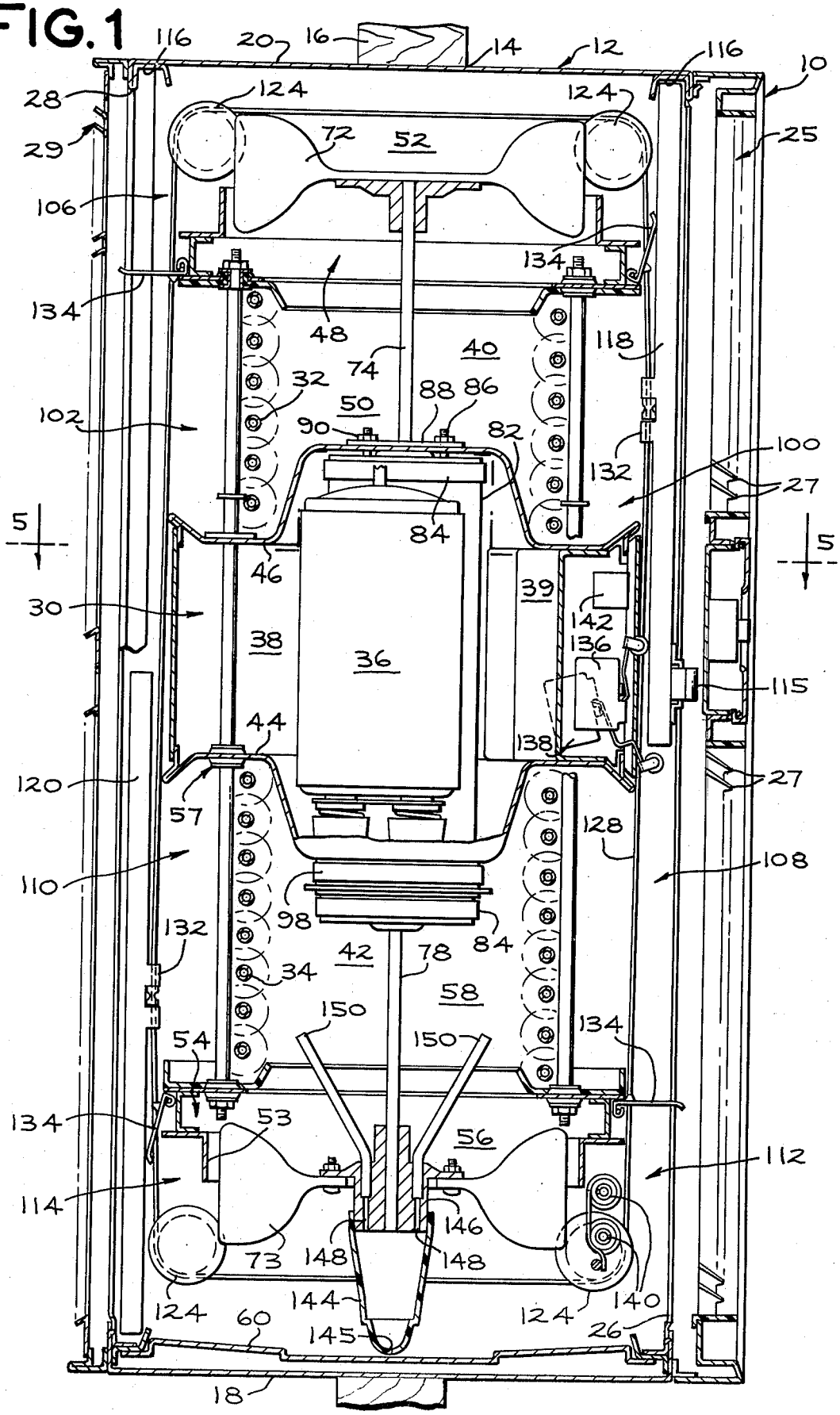
FIG. 1 is a side elevational view in section of the self-contained air conditioning unit incorporating the present invention.

Referring now to the drawings and more particularly to FIG. 1, there is shown an air conditioner unit 10 including a housing 12 that is adapted to be arranged in an opening 14 in the wall 16 of an enclosure to be conditioned. The housing 12 is generally rectangular in shape (FIG. 2) and includes bottom and top walls 18 and 20 respectively interconnected by longer side walls 22 and 24. The housing walls (FIG. 1) define generally a front opening 26 disposed in the enclosure side of wall 16 and a rear opening 28 disposed in the outdoor side of wall 16. Arranged over the front opening 26 of housing 12 is a front grille or appearance member 25 which includes appropriate air deflecting vanes 27, while a grille 29 is positioned over the rear opening 28.

Figure 2:
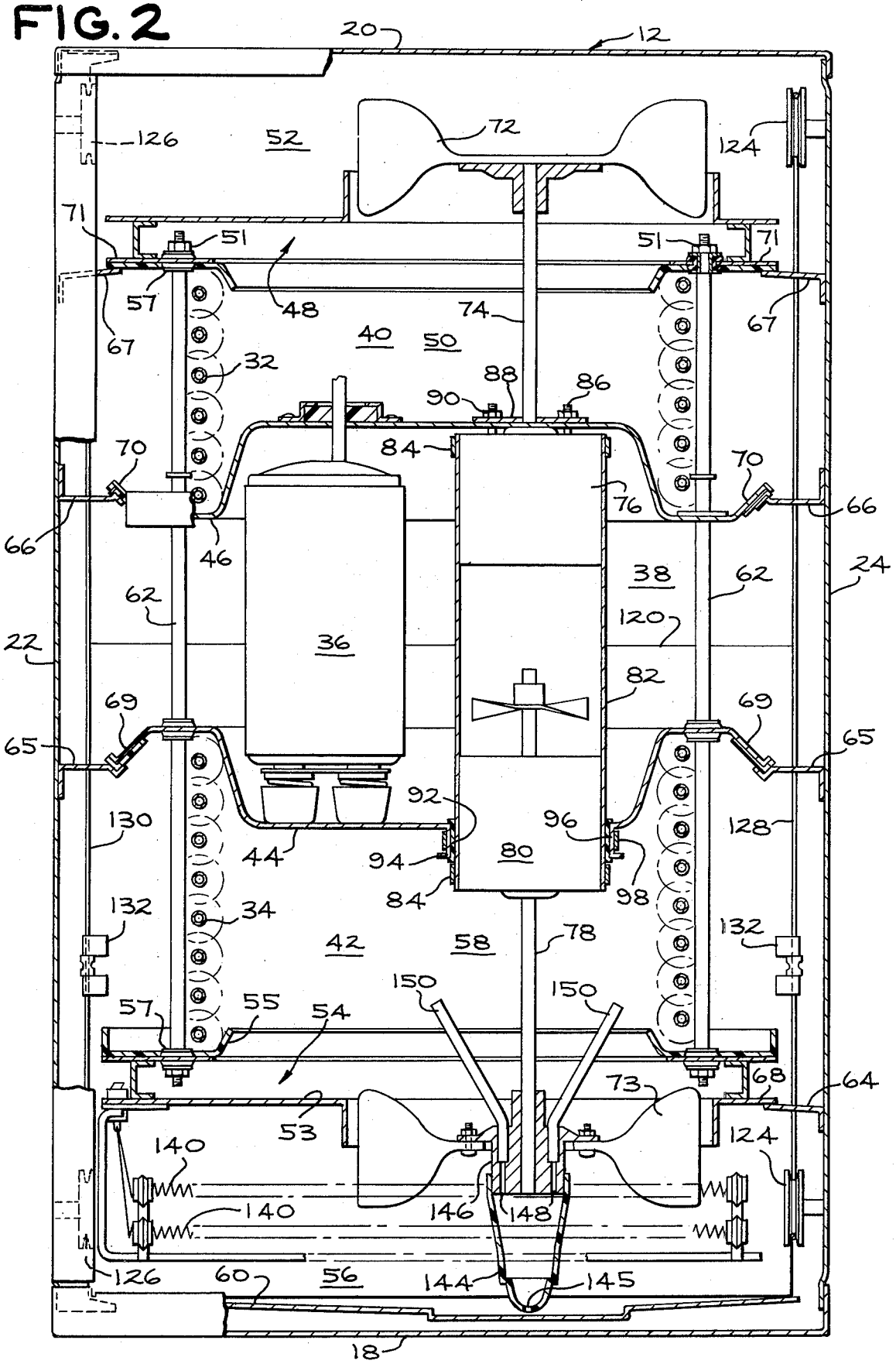
FIG. 2 is a front elevational view partially in section of the self-contained air conditioning unit incorporating the present invention.
Figure 3:
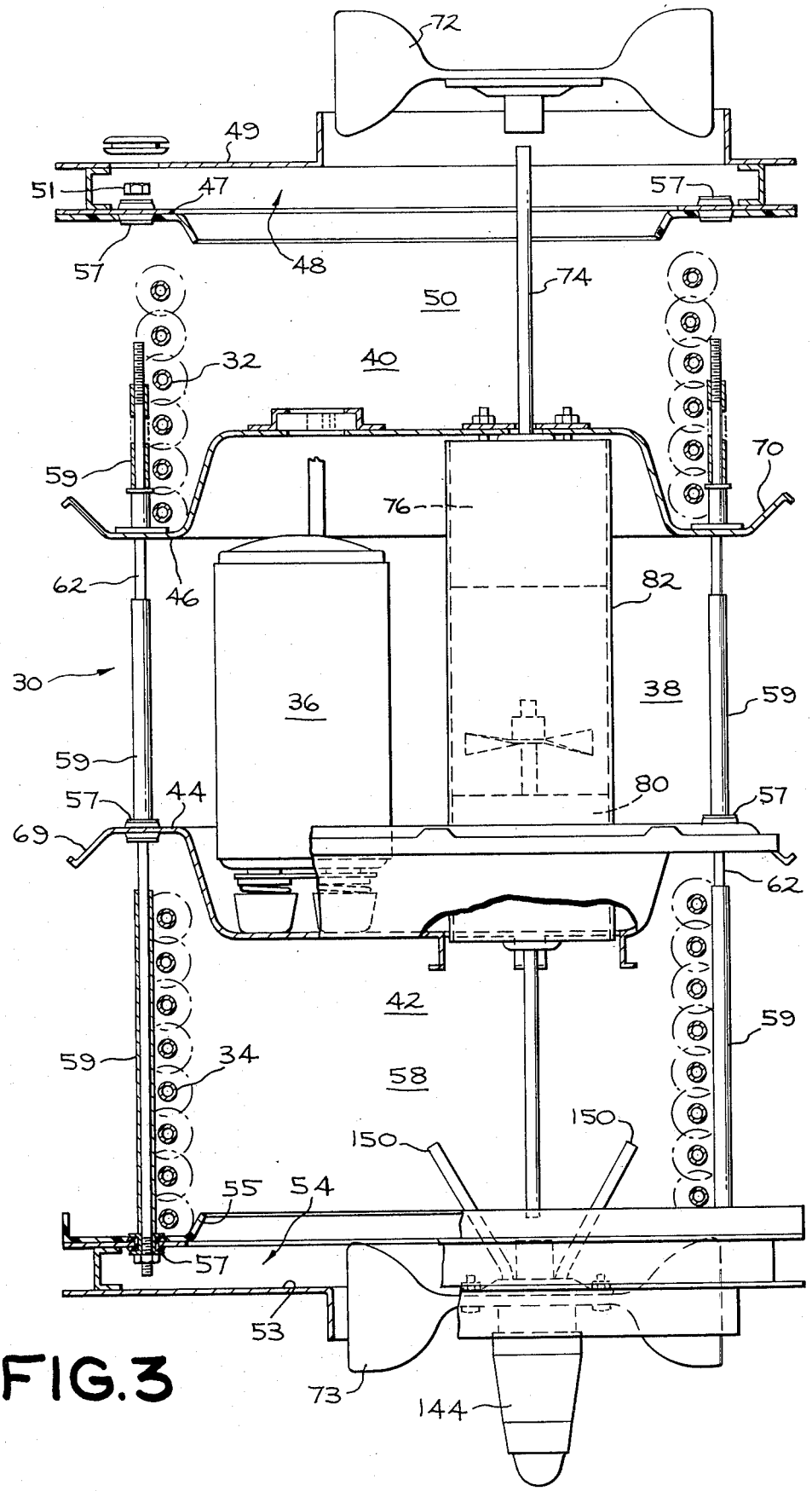
FIG. 3 is an elevational view of the chassis supporting the refrigeration system of the present unit.

Mounted within the housing 12 in a manner to be fully described hereinafter is a removably arranged chassis 30. Mounted on chassis 30, as shown in FIG. 3, is the air conditioner refrigeration system including an evaporator 32 and a condenser 34 connected in refrigerant flow relationship with a compressor 36. Referring to FIGS. 1—3, it will be seen that the chassis 30 includes a plurality of parallel spaced partitions that divide the housing 12 in a manner to be explained hereinafter to include a central or machine compartment 38, which houses the compressor 36 and a control box 39, an upper or evaporator compartment 40 and a lower or condenser compartment 42. The partitions of chassis 30 include two spaced substantially parallel central partitions 44 and 46 which define the central compartment 38. An upper fan shroud partition member 48 substantially divides the upper evaporator compartment 40 into an inlet area 50 defined by member 48 and partition 46 and an outlet area 52 defined by member 48 and the upper wall 20 of housing 12. The evaporator 32 is securely held between the partitions 46 and 48 in the inlet area 52. A lower fan shroud partition 54 substantially divides the lower condenser compartment 42 into an outlet area 56 defined by the member 54 and partition 44 and an inlet area 58 defined by member 54 and sump pan 60 arranged in the lower wall 18 of housing 12. The condenser 34 is securely held between the partitions 44 and 54 in the outlet area 56. The partitions are supported in their spaced relationship by a plurality of support members or rods 62.

The chassis 30 is removably supported in the housing 12 through the partitions 44, 46, 48 and 54 as shown in the front elevational view of FIG. 2. The housing 12 has pairs of support members 64, 65, 66 and 67 secured to opposite side walls 22 and 24. Each pair of support members 64, 65, 66 and 67 project inwardly toward each other from their respective side walls and extending partially into the front and rear housing openings 26 and 28 respectively. Formed on the side edge portions of the partitions 54, 44, 46 and 48 are guides portion or members 68, 69, 70 and 71 which are dimensioned to engage the members 64, 65, 66 and 67 respectively secured to the housing 12 to effectively support the chassis 30 in the housing 30. The chassis 30 may be noise and vibration isolated from housing 12 by providing resilient members that are disposed between the pairs of support members 64, 65, 66 and 67 and their associated guide members.

Air is circulated by a fan 72 arranged in shroud 48 from the evaporator inlet section 50 to evaporator outlet section 52 and similarly air is circulated by a fan 73 arranged in shroud 54 from the condenser inlet 58 to condenser outle section 56. Fan 72 is mounted on the shaft 74 of a motor 76 while fan 73 is mounted on the shaft 78 of a motor 80. By the present invention, means are provided that result in low noise levels and the elimination of substantially all of the motor vibrations from passing through to the chassis.

To this end, the motors 76 and 80 are part of motor assembly and are mounted in a common cylinder sleeve 82. The motors 76 and 80 are secured to the sleeve 82 by clamps 84 encompassing the sleeve 82 adjacent each axial end thereof. The assembly including the sleeve 82 and motors 76 and 80 is mounted to the partitions 44 and 46 as a unit. With regard to partition 46, bolts 86 secured to and projecting upwardly from the motor 76 pass through appropriate openings in partition 46. A resilient member 88 is positioned between the bolts 86 and partition 46 by nuts 90 in a manner that effectively isolates the motor assembly from partition 46. The lower portion of sleeve 82 passes through and extends into an opening 92 formed in the partition 44. Formed along the edge of the opening 92 is a circumferentially disposed flange 94 which is lined with a resilient ring 96. The ring 96 is in effect interposed between the flange 94 formed in partition 44 and sleeve 82 to isolate the motor assembly from partition 44 at its lower end. A clamp 98 secures the lower end of sleeve 82 to partition 44.

Referring now to FIG. 3 there is shown the chassis 30 in its partially assembled position. The refrigeration system components are arranged on, and the chassis assembled in the following manner.

As mentioned hereinbefore the partitions are supported by the rods 62 that pass through each of the partitions. In the instant embodiment four rods are provided one adjacent each corner of the chassis partitions as seen in FIG. 5. In assembling the chassis, the lower ends of the rods 62 are initially secured to the lower partition 54. Partition 54 includes a shroud member 53 and a support member 55 that is provided with holes dimensioned to receive the rods as shown in FIG. 3. Arranged in the holes of member 55 are resilient members 57 that isolate the rods from the member 55. The condenser 34 is positioned on the member 55 within the area defined by the rods 62 as shown in FIG. 5. The partition 44 which has the compressor 36 mounted thereon is then placed on the rods 62. Similar to member 55 the holes in partition 44 are also provided with resilient members 57 that isolate the rods from partition 44. The free ends of the condenser 34 (not shown) are arranged to pass through openings in the partition 44 so as to be positioned in the compartment 38 in the completed assembly of the chassis 30. In the next step in assembling the chassis 30 the partition 46 which has the upper portion of the motor assembly 82 secured thereto in the manner explained above is placed on the rods 62 in the same manner as partition 44 including resilient members 57 interposed between the rods and partition 44. It should be noted that the motor assembly 82 and more particularly its lower end is in alignment with and partially in the opening 92 of partition 44. The evaporator 32 is positioned on the upper surface of the partition 46 within the area defined by the rods 62. The free ends of the evaporator 32 like those of the condenser 34 are arranged to pass through openings in the partition 46 so as to be positioned in the compartment 38 in the completed assembly of the chassis 30. The upper partition 48 is similar to the lower partition 54 and includes a shroud member 49 and a support member 49 that are provided with holes to receive the rods 62. Arranged in the holes of members 47, 49 are resilient members 57 that isolate the rods from the member 48. The assembly is completed by securing nut 51 to the threaded upper ends of the rods 62. It should be noted that to insure the proper vertical dimension of the compartments cylindrical members or sleeves 59 are arranged on the rods 62 between each partition. In order to insure that all of the air entering the inlet sections 40, 42 passes through the heat exchangers the sleeve members 59 in the inlet sections have an axial dimension that is less than the free vertical dimension of the heat exchangers as shown in FIG. 3. This arrangement insures that the heat exchangers are in engagement with the partitions holding them and that air will not pass therebetween.

Referring to FIG. 1, it can be seen that the inlet and outlet sections of the evaporator and condenser compartments are arranged within the rectangular housing 12 with each section having a pair of openings therein, one communicating with opening 28 facing the outdoors, and a second opening communicating with opening 26 facing the enclosure whereby air can be both introduced and discharged from the evaporator and condenser compartments in two different directions. More specifically, the evaporator compartment inlet section 50 contains openings 100 and 102 and the outlet section 52 contains openings 104 and 106 in the indoor and outdoor side respectively of housing 12. Similarly condenser compartment inlet section 58 is provided with openings 108 and 110, and the outlet section 56 is provided with opening 112 and 14 in the indoor and outdoor side respectively of housing 12. As will be hereinafter explained the inlet and outlet openings of each compartment on the indoor and outdoor side of housing 12 is provided with means for selectively controlling the air flow through the condenser and evaporator compartments.

It should be noted that the evaporator 32 and the condenser 34 are of the spine fin type consisting of one continuous tube member wound spirally so that each heat exchanger is arranged in circular fashion within their respective compartment inlet sections. This configuration is desirable because the inlet openings 100, 102 and 108, 110 leading to their respective sections 50 and 58 are arranged opposite sides thereof and accordingly, the air flows into the sections from opposite directions. That is, by this heat exchanger configuration it is possible to more efficiently take advantage of all of the space within each of the inlet sections and to utilize the capacity of the heat exchangers to their fullest extent regardless of the direction of air flow.

As may be seen in FIG. 1, the front openings 26 and 28 of housing 12 are provided with channel or track portions 116 that extend completely around the openings. Each opening 26 and 28 is provided with means for controlling air flow through the evaporator and condenser compartments. In the present embodiment, air flow is controlled by a pair of air valves or dampers 118 and 120 that are fitted for vertical movement in the track portions 116 on the openings 26 and 28 respectively.

In the illustrated embodiment of the invention, the dampers are interconnected to insure proper location of one damper over a compartment inlet and outlet opening one one side of the housing by movement of the other damper arranged on the other side of the housing. To this end (FIG. 2), there is provided a first set of four rollers 124 rotatably mounted on the side wall 24 of housing 12 and a similar set of four rollers 126 rotatably mounted on the side wall 22 of housing 12. With reference to FIG. 1, it will be seen that the rollers are mounted near the corner portions of the side walls to, in effect, outline a rectangle on each side wall. Arranged on rollers 124 is an endless cable 128, while an endless cable 130 is arranged on the rollers 126. The front damper 118 is secured to each vertical pass of the cables 128, 130 at a point where they communicate with the front opening 26, while the back damper 120 is secured to the cables 128, 130 at a point where they communicate with the back opening 28. To this end, the dampers are provided with fastening portions 132 located on the vertical edge thereof that is crimped to the cables. Accordingly, vertical movement of the front damper 118 positioned in the enclosure side of housing 12 by the user of the air conditioner will cause an opposite vertical movement of the back damper 120 positioned in the outdoor side of the housing 12.

In use with the dampers 118, 120 arranged in the heating position shown in FIG. 1, the air flow through the conditioner 10 is such as to heat the air circulated from the enclosure. That is in the heating mode with the damper 118 closing the enclosure side inlet openings 100 and outlet opening 104 of evaporator compartment 40, air from the enclosure is drawn into the condenser compartment 42 through inlet 108 where it is passed through the condenser 34 heated and then back into the enclosure through outlet 112. In the heating mode, damper 120 closes the outside inlet openings 110 and outlet opening 114 of the condenser compartment 42 and air from the outdoors is drawn into the evaporator compartment through inlet 102 where it is passed through the evaporator 32 and back into the outdoors through outlet 106.

In the cooling mode the indoor damper 118 would be positioned by the user of the air conditioner over the enclosure side condenser inlet 108 and outlet 112 section openings so that enclosure air is drawn into the evaporator compartment through uncovered inlet 100 where it is passed through the evaporator and cooled and then back into the enclosure through outlet 104. In this mode the outdoor damper 120 would be positioned over the outdoor evaporator inlet 102 and outlet 106 openings so that outdoor air is drawn into the uncovered condenser compartment 42 through inlet 110 where it is passed through the condenser and then back into the outdoors through outlet 114. To facilitate movement of the indoor damper 118 by the user there is provided a pair of handles 115 as shown in FIGS. 1 and 5. The handles 115 include a portion 117 slidably arranged in a sleeve 119 which is secured to the front surface of damper 118 and a handle portion 121. The handle portion 121 extends between the front wall of housing 12 and grille 25 for easy access by the user. For ease in gripping, the handles 115 may be extended to the broken line position shown in FIG. 5.

Means are also provided in the present invention to insure against air leaks or air to short circuit between the inlet and outlet sections of the compartments on the opposite or closed side of the housing.

To this end movable sealing flaps 134 are arranged along the front and rear edge portions of the partition 48 dividing evaporator compartment 40 and along the front and rear edge portions of the partition 54 dividing the condenser compartment 42. Referring to FIG. 4, it will be seen that the flaps 134 are pivotally mounted on the edge portions of the partition and are biased in an extended or horizontal position by a spring 136. In this extended position shown in FIG. 1, the damper 118 engages the indoor flap 134 associated with the evaporator compartment 40 to prevent short circuiting a portion of the air moving between sections 50, 52 on the indoor side of the housing thereby insuring that substantially all of the air passes through the evaporator, while the damper 120 engages the outdoor flap 134 associated with the condenser compartment 42 to prevent short circuiting a portion of the air moving between sections 56, 58 on the outdoor side of the housing thereby insuring that substantially all of the air passes through the condenser. Movement of the dampers to the cooling position would of course cause engagement by the damper 118 of flap 134 on the indoor side of the condenser compartment and of the flap 134 on the outdoor side of the evaporator compartment.

Control means are provided that prevent operation of the unit in the event the damper doors or air valves are not positioned properly relative to the selected inlet and outlet openings. To this end, there is mounted in the control box 39 a pair of switches 136 and 138. The switch 136 is a heater control switch through which a resistance heater 140 is energized. The switch 136 is moved to its closed position when the damper 118 is in its up position and enclosure air is accordingly circulating through the condenser compartment 42. The switch 136 also orients the thermostat 142 so that it functions during the heating cycle between a lower ambient and a higher set temperature. The switch 138 is effective in locking out the heater 140 when the damper is in its down or cooling position and enclosure air is accordingly circulating through the evaporator compartment 40. Besides locking out the circuit to the heater 140, the switch 138 orients the thermostat 142 so that it functions during the cooling cycle between a higher ambient and lower set temperature. Another feature of the switch arrangement is to prevent operation of the air conditioner if both switches are closed. In effect, the switches are so arranged that the damper 118 must be either in its fully up heating position which means damper 120 is in its fully lowered position or in its down position, or cooling position which means damper 120 is in its fully up position.

Condensate forming on the evaporator 32 is collected on the partition 46 and directed to a sump pan 140 arranged on the lower wall 18 of housing 12 by a hose or other appropriate conduit (not shown). In the present instance the unit is not supplied with a drain and accordingly means are provided for disposing of the condensate from the sump pan 60. To this end a member 144 which as shown is substantially in the form of a cone with the apex portion positioned in the lowermost portion of the sump 60. The cone shaped member includes an opening 145 in the apex area and is attached at its upper end to the hub 146 of fan 72 for rotation therewith. The hub 146 is provided with passageways 148 whose lower openings communicate with the interior of member 144. Connected to the upper end of passageways 148 are tube members 150 that extend upwardly and partially outwardly in the direction toward the condenser 34. During operation of the air conditioning unit condensate may accumulate in the sump 60 so that the lower end of member 144 including opening 145 is submerged in the water. In this situation, as the member 144 rotates, it imparts a centrifugal action on the condensate or water causing it to enter opening 145 and to rise quickly up the inner inclined walls of member 144. Water traveling up the walls of member 144 moves through passageways 148 and tube members 150. The velocity of the water traveling through tube 150 is sufficient to cause the water to be thrown against the relatively hot surfaces of the condenser 34 where it dissipates in the air passing therethrough.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An air conditioning apparatus for conditioning air in an enclosure having a wall opening comprising:

a housing having openings on opposite sides thereof adapted to be positioned in said wall opening with the opening on one side of said housing facing the outdoors and the opening on the other side of said housing facing said enclosure;

a central chamber defined by spaced partition means dividing said housing into an evaporator compartment and a condenser compartment;

a refrigerating system including a condenser, an evaporator and a compressor;

a fan shroud partition means in each of said compartments substantially dividing said compartments into inlet and outlet sections, each of said sections having an opening in both the indoor and outdoor facing side of said housing; a fan within each of said shrouds for circulating air through each of said compartments in a direction from said inlet section to said outlet section;

said evaporator and said condenser being of the spine fin type, consisting of one continuous tube member wound spirally so that each heat exchanger is arranged in circular fashion and positioned generally around the fan in the shroud partition within their respective compartments, means for connecting said partition means in spaced relationship to form a refrigeration system chassis adapted to be received in said housing, said connecting means including members being dimensioned so that said spirally wound evaporator being arranged in said evaporator compartment between the upper central compartment partition means and said evaporator compartment fan shroud partition means is compressed and securely held therebetween and also said connecting members being dimensioned so that said condenser being arranged in said condenser compartment between the lower central compartment partition and said condenser compartment fan shroud partition means is compressed and securely held therebetween and said compressor being arranged in said central chamber to define a system chassis arranged in said housing, a fan motor mounted in one of said central chamber partitions having a shaft extending into said evaporator compartment for driving one of said fans, and a second fan motor mounted in the other of said central chamber partitions having a shaft extending into said condenser compartment for driving the other of said fans;

a first damper slidably arranged in the indoor facing side of said housing being associated with the indoor facing openings of said compartments; said damper is dimensioned to cover the openings of one of said compartments, a second damper slidably arranged in the outdoor facing side of said housing being associated with the outdoor facing opening of said compartments, said damper dimensioned to cover the opening of the other of said compartments; and means for selectively positioning said dampers to a first cooling position wherein the indoor facing openings of said evaporator compartment communicate with the enclosure and the outdoor facing openings of said condenser compartment communicate with said outdoors for cooling the air in said enclosure and to a second heating position wherein the indoor facing openings of said condenser compartment communicate with the enclosure and the outdoor facing openings of said evaporator compartment communicate with said outdoors for heating the air in said enclosure.

2. The air conditioning apparatus recited in claim 1 wherein said housing is substantially rectangular and includes top and bottom walls interconnected by substantially longer side walls, and further including a plurality of pairs of support members arranged on opposite side walls of said housing, guide means formed on the opposite edge portions of said partition means, said guide means on each of said partition being dimensioned to engage a pair of said support members for removably supporting the refrigeration system chassis in said housing.

3. The air conditioning apparatus recited in claim 2 wherein resilient means are disposed between said support members and said guide means of isolating said chassis from said housing.

4. The air conditioning apparatus recited in claim 1 further including means for directing moisture precipitated from the stream of air cooled by the evaporator to the stream of air passing through the condenser for evaporation therein.

5. The air conditioning apparatus recited in claim 4 wherein said means for directing moisture includes a sump member arranged below said condenser for collecting moisture from said evaporator, a pump member mounted on the hub portion of said condenser fan for rotational movement therewith, said pump member having a diameter which gradually increases from the bottom to the top with the lowermost portion being arranged in said sump so as to be submersed in said moisture when present, an aperture in the lower portion of said pump member communicating with the interior thereof, passageways in said hub portion extending axially therethrough having one end in communication with the interior of said pump member, tube members arranged in the upper openings of said passageways extending upwardly and outwardly interiorly of said spirally wound condenser so the centrifugal force will lift moisture from said pump when present and cause it to be thrown against the relatively warm interior surface of said condenser.

6. The air conditioning apparatus recited in claim 1 or 5 further including connecting means associated with both of said dampers so that movement of one of said damper arranged in one of said housing openings to a position over one of said compartment openings causes movement of said damper on the other of said housing opening to a position over the other of said compartment openings.

7. The air conditioning apparatus recited in claim 4 further comprising fan motor support means including a substantially cylindrical member, said fan motors being mounted at the axial ends of said cylindrical member, means for resiliantly mounting one of said fan motors on the upper central compartment partition, said cylindrical member extending through the lower central compartment partition, resilient mounting means arranged for mounting the other of said fan motors on the lower central chamber partition.

8. The air conditioning apparatus recited in claim 7 further comprising sealing means arranged along substantially the entire edge portion of both of said fan shroud partition means facing said enclosure and outdoor openings of said housing, said indoor facing sealing means being pivotally mounted and biased in a position extending into the plane defining said first damper travel path, and said outdoor facing sealing means being pivotally mounted and biased in a position extending into the plane defining said second damper travel path so that said sealing means are engageable by said damper doors to prevent air flow between the inlet and outlet openings when a damper door is positioned over a selected compartment opening.

9. The air conditioning apparatus recited in claim 8, wherein a resistance heater is arranged in said condenser compartment outlet section adjacent said indoor facing housing opening.

10. The air conditioning apparatus recited in claim 9 further providing switching means arranged in said central compartment including a first switch having a switch actuating member positioned to be engaged by said first dampr when it is in said cooling position to place room thermostat in cooling mode, and a second switch having a switch actuating member positioned to be engaged by said first damper when it is in said heating position to allow said heater to be energized if required to supplement the heat of said condenser and to place room thermostat in heating mode.

11. An air conditioning apparatus for conditioning air in an enclosure having a wall opening comprising:

a housing, including side walls interconnected by a bottom and top wall, adapted for mounting in said wall opening with one open side of said housing facing the enclosure and the other open side of said housing facing the outdoors:

a first partition, including an aperture, disposed within the housing and extending substantially between said side walls defining an outlet area between said partition and the bottom wall of said housing;

a second partition disposed within the housing and extending substantially between said side walls being separate and substantially parallel to the first partition defining an inlet area, including an aperture in axial alignment with the aperture in the first partition;

a fan arranged on the first partition aperture for moving air into said inlet and through said oulet area;

a condenser housed in said outlet area between first and second partition;

a third partition disposed within the housing and extending substantially between said side walls separate and substantially parallel to the first and second partition forming a central compartment between said second and third partitions, including an aperture in axial alignment with the apertures in the first and second partitions;

a compressor housed in said central compartment;

a fourth partition disposed within the housing and extending substantially between said side walls separate and substantially parallel to the third partitions forming a second inlet area between said third and fourth partitions defining a second outlet area between said partition and the top wall of said housing, including an aperture in axial alignment with the other apertures;

an evaporator housed in said second inlet area between the third and fourth partitions;

a fan arranged in fourth partition aperture for moving air into said second inlet area and through said second outlet area; and driving means in said central compartment arranged in the apertures of said second and third partitions, including axial shaft means for driving said fans in said first and fourth partition apertures respectively;

a first damper arranged in one opening of said housing moveable between a first position over said first inlet and said first outlet for allowing circulation of enclosure air between said second inlet area and said second outlet for cooling said enclosure air to a second position over said second inlet area and said second outlet area for allowing circulation of enclosure air between said first and second compartments for heating said enclosure;

a second damper arranged in the other opening of said housing being interconneced to said first door so that it is positioned to circulate air through said evaporator to said outdoors when said indoor air is being heated and positioned to circulate air through said condenser to said outdoors when said indoor air is being cooled.

12. The air conditioning apparatus recited in claim 11 further comprising means for connecting said partition means in spaced relationship to form a refrigeration system chassis, said evaporator being arranged in said evaporator inlet area between said third and fourth partition means, said condenser being arranged in said condenser inlet area between said first and second partition means, between said second and third partition means and said compressor being arranged in said central compartment to define a system chassis arranged in said housing.

13. The air conditioning apparatus recited in claim 12 wherein said evaporator and said condenser are of the spine fin type consisting of one continuous tube member wound spirally so that each heat exchanger is arranged in circular fashion around the fan in the shroud partition within their respective compartments.

14. The air conditioning apparatus recited in claim 13 wherein said housing is substantially rectangular and includes top and bottom walls interconnected by substantially longer side walls, and further including a plurality of pairs of support members arranged on opposite side walls of said housing, guide members formed on the opposite edge portions of said partition means dimensioned for engaging said support member for removably supporting the refrigeration system chassis in said housing.

15. The air conditioning apparatus recited in claim 14 wherein resilient means are disposed between said support members and said guide means for isolating said chassis from said housing.

16. The air conditioning apparatus recited in claim 15 further including means for directing moisture precipitated from the stream of air cooled by the evaporator to the stream of air passing through the condenser for evaporation therein.

17. The air conditioning apparatus recited in claim 16 wherein said means for directing moisture includes a sump member arranged below said condenser for collecting moisture from said evaporator, a pump member mounted on the hub portion of said condenser fan for rotational movement therewith, said pump member having a diameter which gradually increases from the bottom to the top with the lowermost portion being arranged in said sump so as to be submersed in said moisture when present, an aperture in the lower portion of said pump member communicating with the interior thereof, passageways in said hub portion extending axially therethrough having one end in communication with the interior of said pump member, tube members arranged in the upper openings of said passageways extending upwardly and outwardly interiorly of said spirally wound condenser so the centrifugal force will lift moisture from said pump when present and cause it to be thrown against the relatively warm interior surface of said condenser.

18. The air conditioning apparatus recited in claim 17 further including connecting means associated with both of said dampers so that movement of one of said dampers arranged in one of said housing openings to a position over one of said inlet and outlet openings causes movement of said damper on the other side of said housing opening to a position over the other of said inlet and outlet openings.

19. The air conditioning apparatus recited in claim 18 further comprising fan motor support means including a substantially cylindrical member, said fan motors being mounted at the axial ends of said cylindrical member, means for resiliently mounting one end of said cylindrical member on the third partition, said cylindrical member extending through the second partition, resilient mounting means arranged for mounting the other of said cylindrical member on the second partition.

20. The air conditioning apparatus recited in claim 19 further comprising sealing means arranged along substantially the entire edge portion of both of said fan shroud partition means facing said enclosure and outdoor openings of said housing, said indoor facing sealing means being pivotally mounted and biased in a position extending into the plane defining said first damper travel path, and said outdoor facing sealing means being pivotally mounted and biased in a position extending into the plane defining said second damper travel path so that said sealing means are engageable by said damper doors to prevent air flow between the inlet and outlet openings when a damper door is positioned over a selected compartment opening.

21. The air conditioning apparatus recited in claim 20, wherein a resistance heater is arranged in said condenser compartment outlet section adjacent said indoor facing housing opening.

22. The air conditioning apparatus recited in claim 21 further providing switching means arranged in said central compartment including a first switch having a switch actuating member positioned to be engaged by said first damper when it is in said cooling position to prevent energization of said resistance heater, and a second switch having a switch actuating member positioned to be engaged by said first damper when it is in said heating position to allow said heater to be energized if required to supplement the heat of said condenser.

* * * * *